US005321996A

United States Patent [19]

Wei

[11] Patent Number: 5,321,996

[45] Date of Patent: Jun. 21, 1994

[54] NAIL HOLDER

[76] Inventor: Deng-Wong Wei, 10F, No. 17, Sec. 2, Fu-Hsing S. Rd., Taipei, Taiwan

[21] Appl. No.: 116,562

[22] Filed: Sep. 7, 1993

[51] Int. Cl.[5] ..... B25C 3/00

[52] U.S. Cl. ..... 81/44

[58] Field of Search ..... 81/487, 44, 13

[56] References Cited

U.S. PATENT DOCUMENTS 3,682,213 8/1972 Litz ..... 81/44

4,008,741 2/1977 Holstein ..... 81/44

4,766,782 8/1988 Tanner ..... 81/44

*Primary Examiner*—D. S. Meislin

[57] ABSTRACT

A nail holder which includes at least one nail holding plate respectively and pivotably received in a rectangular casing, each nail holding plate having two rows of nail holes disposed along two opposite long sides thereof in different diameters for holding different nails, and rents respectively and outwardly extended from the nail holes to the border through which the respective nail holding plate can be removed from the nail been driven in the workpiece.

3 Claims, 4 Drawing Sheets

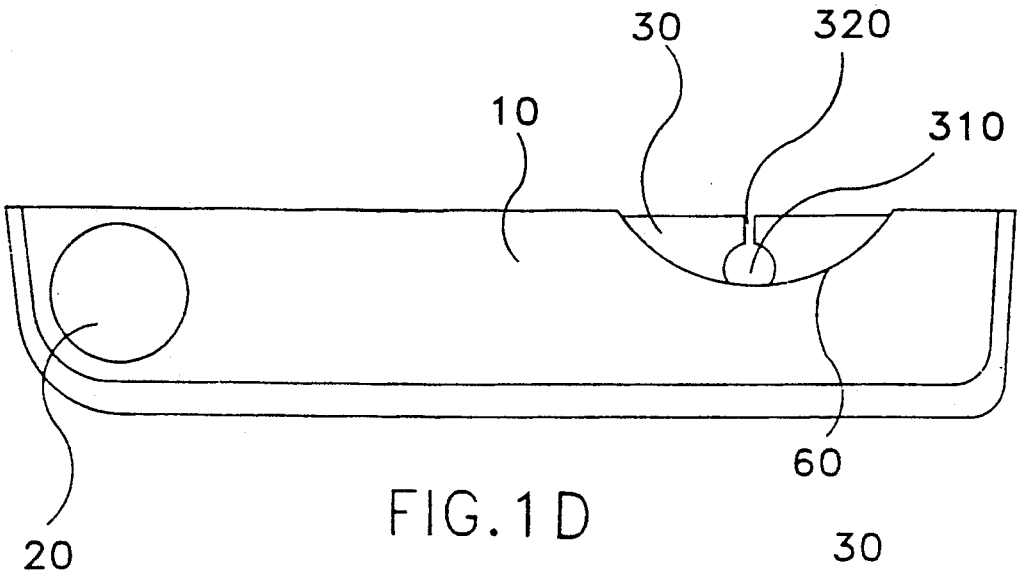
FIG. 1D
FIG. 1B
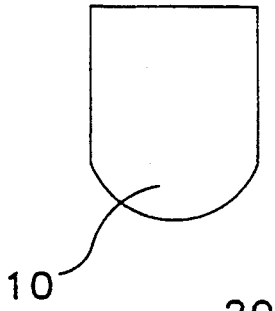
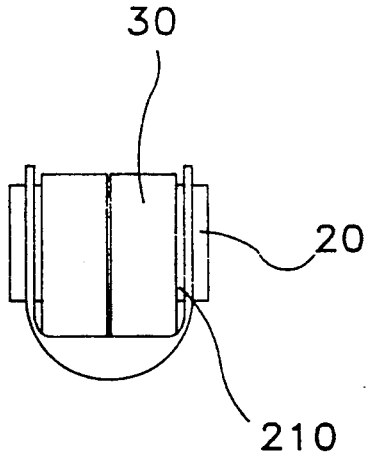
FIG. 1C
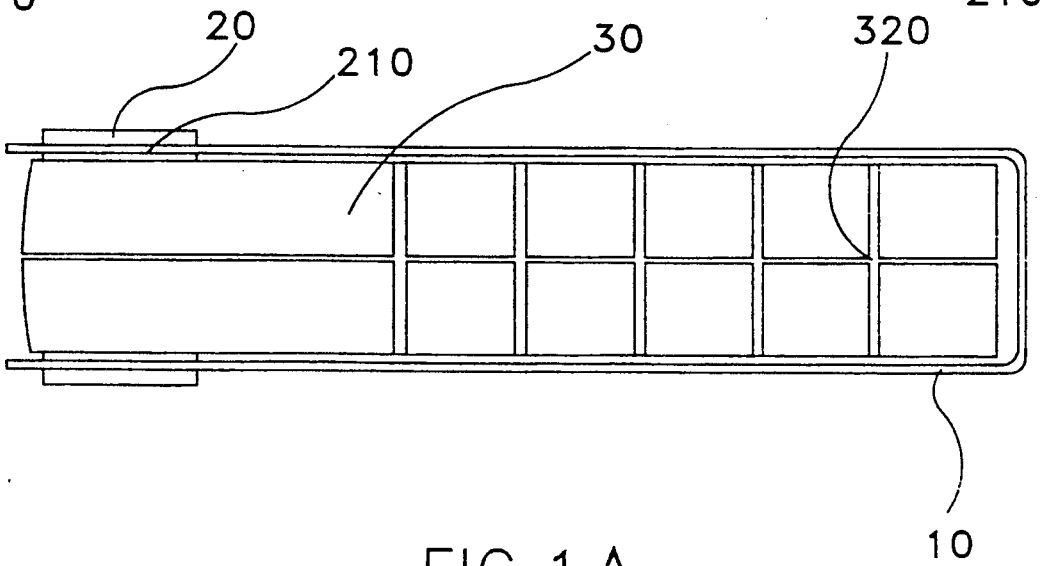
FIG. 1A

NAIL HOLDER

BACKGROUND OF THE INVENTION

The present invention relates to a nail holder and more particularly to such a nail holder for holding any of a variety of nails while nailing.

In making wooden furnitures, upholstering a room, or fastening wooden members, a variety of nails may be used for holding things together. While nailing, the nail is held with fingers and then driven in by a hammer. While hammering the nail, the fingers may be injured by the hammer easily. If the nail is to be driven in a harden object (for example: the concrete wall), the fingers may be hurt by the severe shock. Further, the nail after driven may be out of the course, or tilted and caused to deform as it is held with the fingers while nailing.

SUMMARY OF THE INVENTION

The present invention has been accomplished under the aforesaid circumstances. It is therefore the main object of the present invention to provide a nail holder which holds the nail safely while nailing. It is another object of the present invention to provide a nail holder which holds the nail accurately in position while nailing. It is still another object of the present invention to provide a nail holder which holds the nail and protects it from being deformed while nailing.

According to the preferred embodiment of the present invention, the nail holder comprises two nail holding plates respectively and pivotably received in a rectangular casing. Each nail holding plate has two rows of nail holes disposed along two opposite long sides thereof in different diameters for holding different nails, and rents respectively and outwardly extended from the nail holes to the border through which the respective nail holding plate can be removed from the nail been driven in the workpiece. The casing has a side notch through which the nail holding plates can be turned out of the casing with the fingers.

BRIEF DESCRIPTION OF THE DRAWINGS

FIGS. 1A, 1B, 1C and 1D are respective the front view, right and left side view, and top view of the nail holder of the preferred embodiment of the present invention;

DETAILED DESCRIPTION OF THE PREFERRED EMBODIMENT

Figure 2:
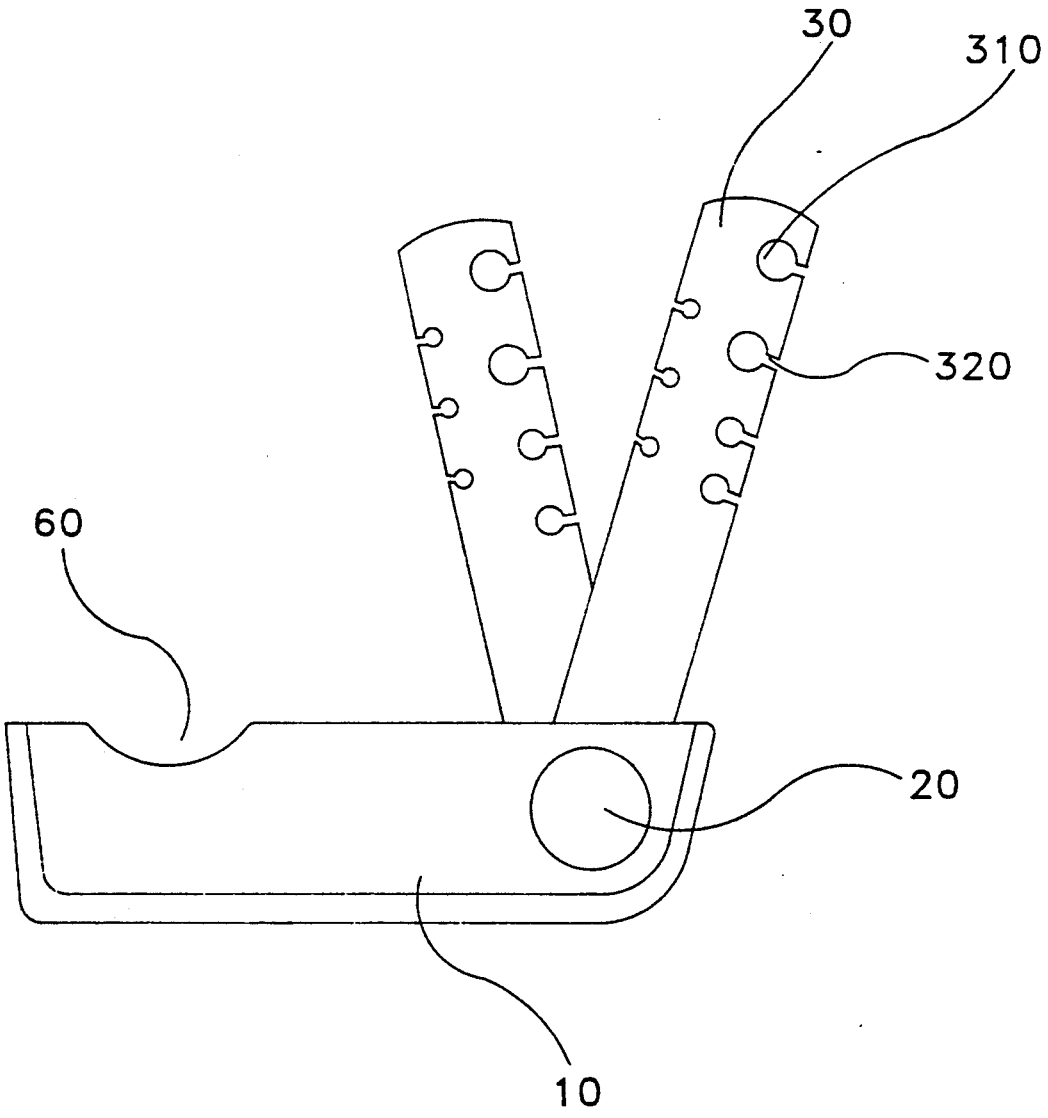
FIG. 2 is an elevational view of the nail holder.

Referring to FIGS. 1A, 1B, 1C, 1D and 2, a nail holder in accordance with the present invention is generally comprised of two nail holding plates 30, and a casing 10. The casing 10 is made of a rectangular open frame for receiving the two nail holding plates 30. According to the preferred embodiment of the present invention, there are two nail holding plates 30 pivotably received in the casing 10 at one end by a pivot 210. The pivot 210 is retained to the casing 10 by end members 20. The casing 10 has an opening (not shown) at one end near the pivot 210 so that the nail holding plates 30 can be turned inwards and received within the casing 10, or extended out of the casing 10 for holding nails. The casing 10 further has a side notch 60 on the long open side thereof through which the nail holding plates 30 can be turned out of the casing 10 with the fingers. Each nail holding plate 30 is respectively made from a flexible material in a rectangular configuration, having two rows of nail holes 310 bilaterally spaced along the length in different diameters for holding different nails, and rents 320 respectively and outwardly extended from the nail holes 310 to the border through which the respective nail holding plate 30 can be removed from the nail been driven in.

Figure 3:
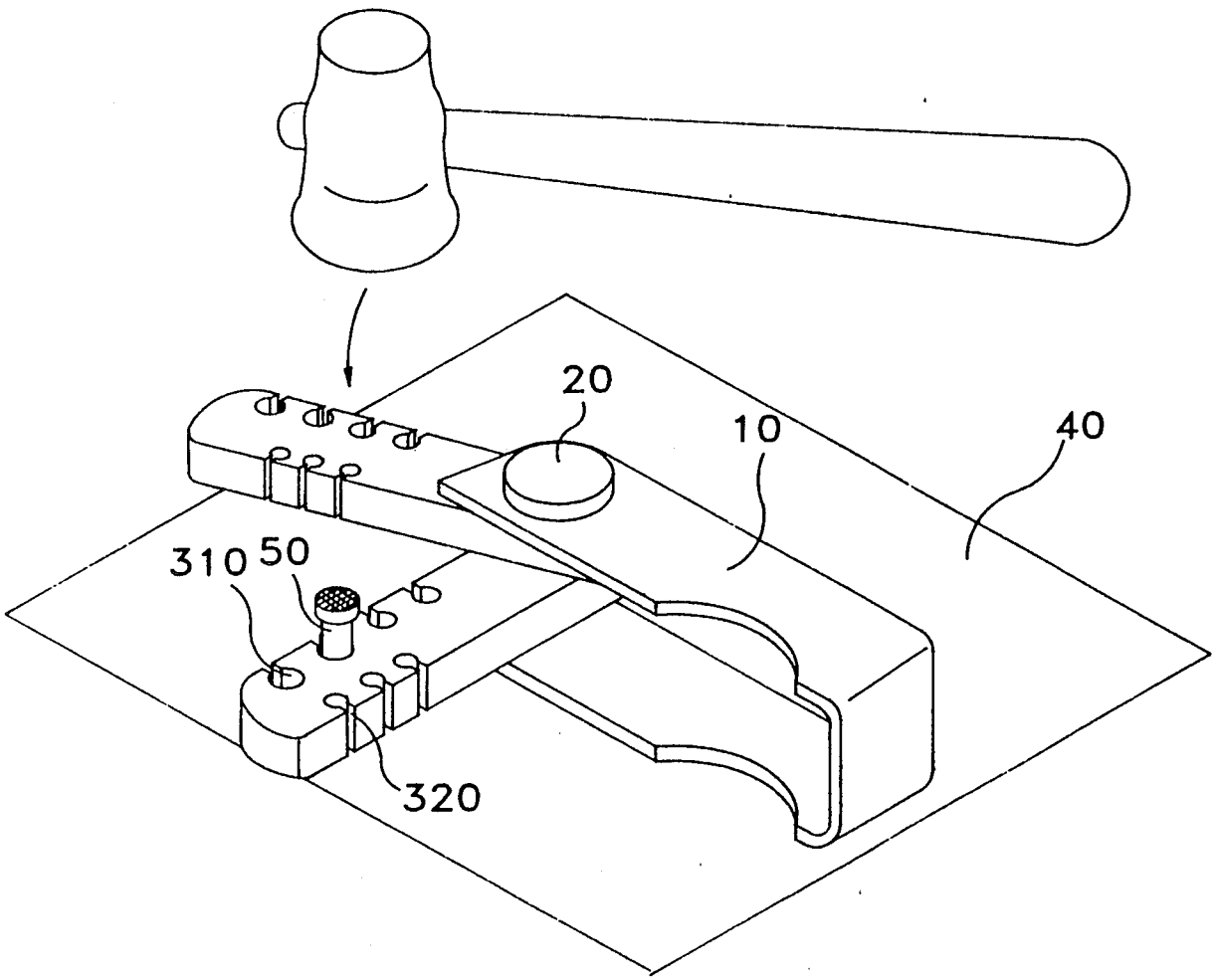
FIG. 3 and FIG. 4 are applied views of the nail holder set to hold a nail while nailing.
Figure 4:
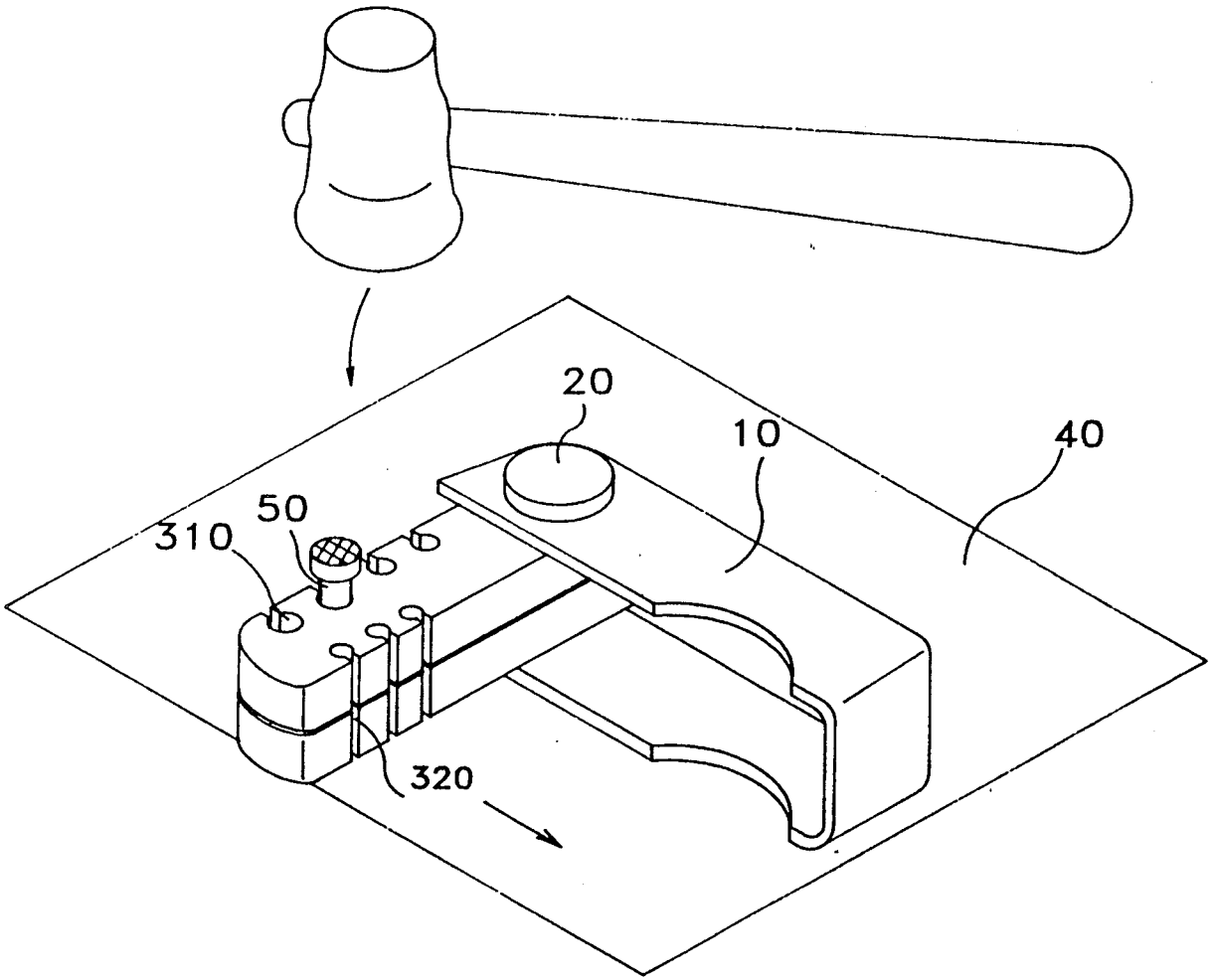

Referring to FIG. 3 and FIG. 4, the nail holding plates 30 are respectively turned out of the casing 10 and disposed above the workpiece 40 to hold a nail 50 in either nail hole 310 as selected. After the most part of the nail 50 has been firmly driven in the workpiece 40, the respective nail holding plate 30 is removed from the nail 50 through the respective rent 320, and then the nail 50 is completely hammered into the workpiece.

What is claimed is:

1. A nail holder comprising a rectangular open casing, and at least one nail holding plate respectively and pivotably received within said casing, said casing having a side notch through which said at least one nail holding plate can be turned out of said casing with the fingers for holding nails, each nail holding plate comprising two rows of nail holes disposed along two opposite long sides thereof in different diameters for holding different nails, and rents respectively and outwardly extended from said nail holes to a plate edge through which the respective nail holding plate can be removed from the nail having been driven in the workpiece.

2. The nail holder according to claim 1 wherein said at least one nail holding plate includes only one nail holding plate.

3. The nail holder according to claim 1 wherein said at least one nail holding plate includes two or more than two nail holding plates.

* * * * *